US006899237B2

(12) United States Patent
Trent

(10) Patent No.: US 6,899,237 B2
(45) Date of Patent: May 31, 2005

(54) BEDDING STORAGE DEVICE

(75) Inventor: Cecilio Trent, 153 Lott Apartment No. 1, Brooklyn, NY (US) 11226

(73) Assignee: Cecilio Trent, Brooklyn, NY (US)

( * ) Notice: Subject to any disclaimer, the term of this patent is extended or adjusted under 35 U.S.C. 154(b) by 0 days.

(21) Appl. No.: 10/310,925

(22) Filed: Dec. 6, 2002

(65) Prior Publication Data

US 2004/0108291 A1 Jun. 10, 2004

(51) Int. Cl.[7] ..... A47F 7/00
(52) U.S. Cl. ..... 211/189; 211/184; 211/195
(58) Field of Search ..... 211/189, 184, 211/195, 119.006, 149, 85.8, 132.1

(56) References Cited

U.S. PATENT DOCUMENTS

| | | | | | |
|---|---|---|---|---|---|
| 593,404 | A | * | 11/1897 | Prechtel | 211/132.1 |
| 1,890,743 | A | | 12/1932 | Murphy et al. | |
| 2,257,536 | A | * | 9/1941 | Roycroft | 211/126.1 |
| 3,225,939 | A | | 12/1965 | Braun | |
| 3,746,181 | A | | 7/1973 | Benoit | |
| 4,572,593 | A | | 2/1986 | Takamizawa et al. | |
| 4,597,122 | A | * | 7/1986 | Handler et al. | 312/139.2 |
| 4,662,523 | A | * | 5/1987 | Stein et al. | 211/59.2 |
| 4,768,661 | A | * | 9/1988 | Pfeifer | 211/184 |
| 5,018,287 | A | * | 5/1991 | Fast | 40/312 |
| 5,020,173 | A | | 6/1991 | Dreyer, Jr. | |
| 5,025,964 | A | * | 6/1991 | Phirippidis | 211/126.1 |
| 5,070,556 | A | * | 12/1991 | Gloger | 312/334.25 |
| 5,240,124 | A | | 8/1993 | Buday | |
| 5,520,316 | A | | 5/1996 | Chen | |
| D372,016 | S | * | 7/1996 | Wolford | D12/414.1 |
| 5,538,148 | A | * | 7/1996 | Indyk | 211/195 |
| 5,556,178 | A | | 9/1996 | Groebly | |
| 5,713,502 | A | | 2/1998 | Dixon | |
| 6,039,418 | A | | 3/2000 | Thomas | |
| 6,082,069 | A | | 7/2000 | Chennaux | |
| 6,119,288 | A | * | 9/2000 | Hendrickson | 5/97 |
| 6,253,943 | B1 | | 7/2001 | Spykerman et al. | |
| 6,270,049 | B1 | * | 8/2001 | Olvey | 248/441.1 |
| 6,481,585 | B1 | * | 11/2002 | Cloughton | 211/89.01 |

* cited by examiner

*Primary Examiner*—Robert W. Gibson, Jr.
(74) *Attorney, Agent, or Firm*—Carlos R. Villamar; Nixon Peabody, LLP

(57) ABSTRACT

A storage device adapted for storage of bedding underneath a bed includes a bottom section, side sections, end sections, and divider sections. The bottom, side, and end sections define an enclosure, and the divider sections are removably attachable within the enclosure to define storage compartments for bedding. In another embodiment, the bedding storage device includes top and bottom sections, and divider sections. The divider sections are removably attached between the top and bottom sections, and the top, bottom, and divider sections define the storage compartments for the bedding. A height, width, and length of the storage devices are adapted for placement underneath a bed.

13 Claims, 6 Drawing Sheets

BEDDING STORAGE DEVICE

FIELD OF THE INVENTION

The present invention generally relates to storage devices, and more particularly to storage devices for bedding.

DISCUSSION OF THE BACKGROUND

Over the years, various types of devices for storage of various articles on or in drawers, wardrobes, bookcases, stores, automobiles, beds, display cases, etc., have been developed. However, many of the previous attempts, although fulfilling their various objects, suffer from various problems.

For example, U.S. Pat. No. 1,890,743 to Murphy, et al., U.S. Pat. No. 3,225,939 to Braun, U.S. Pat. No. 4,572,593 to Takamizawa, et al., and U.S. Pat. No. 5,240,124 to Buday are directed to storage devices for store counters, delivery of goods and containers, and display cases. U.S. Pat. No. 3,746,181 to Benoit, U.S. Pat. No. 5,556,178 to Groebly, U.S. Pat. No. 6,039,418 to Thomas, and U.S. Pat. No. 6,082,069 to Chennaux are directed to storage devices for drawers, wardrobes, and bookcases. U.S. Pat. No. 5,520,316 to Chen, U.S. Pat. No. 5,713,502 to Dixon, and U.S. Pat. No. 6,253,943 to Spykerman, et al. are directed to storage devices for automobiles. Such devices, however, suffer from a range of problems, including relatively complex design and assembly, and typically not being adapted for storage of bedding underneath a bed. U.S. Pat. No. 5,020,173 to Dreyer Jr. is directed to bedstead storage device. This device, however, also suffers from various problems, including relatively complex design and assembly.

SUMMARY OF THE INVENTION

Therefore, there is a need for a storage device for bedding that is relatively easy to manufacture and assemble, and that is adapted for storage of bedding underneath a bed.

The above and other needs are addressed by the embodiments of the present invention, which provide an improved storage device adapted for storage of bedding underneath a bed. In one embodiment, the bedding storage device includes bottom, side and end sections that define an enclosure for receiving divider sections that are removably attachable within the enclosure and define storage compartments for the bedding. In another embodiment, the bedding storage device includes top and bottom sections, and divider sections that are removably attached between the top and bottom sections to define the storage compartments for the bedding. The height, width, and length of the storage devices are adapted for placement underneath the bed. Advantageously, the size and number of the storage compartments within the storage devices can be varied to accommodate bedding of various sizes.

Accordingly, in one aspect of an embodiment of the present invention, there is provided a storage device adapted for storage of bedding underneath a bed, including a bottom section, side sections, end sections, and divider sections. The bottom, side, and end sections define an enclosure, the divider sections are removably attachable within the enclosure to define storage compartments for bedding, and a height, width, and length of the storage device are adapted for placement underneath a bed.

In another aspect of an embodiment of the present invention, there is provided a storage device adapted for storage of bedding underneath a bed, including top and bottom sections, and divider sections. The divider sections are removably attached between the top and bottom sections, the top, bottom, and divider sections define storage compartments for bedding, and a height, width, and length of the storage device are adapted for placement underneath a bed.

Still other aspects, features, and advantages of the present invention are readily apparent from the following detailed description, simply by illustrating a number of particular embodiments and implementations, including the best mode contemplated for carrying out the present invention. The present invention is also capable of other and different embodiments, and its several details can be modified in various respects, all without departing from the spirit and scope of the present invention. Accordingly, the drawings and corresponding descriptions are to be regarded as illustrative in nature, and not as restrictive.

BRIEF DESCRIPTION OF THE DRAWINGS

The various embodiments of the present invention are illustrated by way of example, and not by way of limitation, in the figures of the accompanying drawing, in which like reference numerals refer to similar elements, and in which.

DETAILED DESCRIPTION OF THE PREFERRED EMBODIMENTS

A storage device adapted for storage of bedding underneath a bed is described. In the following description, for purposes of explanation, numerous specific details are set forth in order to provide a thorough understanding of the various embodiments of the present invention. It is apparent to one skilled in the art, however, that the described embodiments can be practiced without these specific details or with an equivalent arrangement. In some instances, well-known structures and devices are shown in block diagram form in order to avoid unnecessarily obscuring the described embodiments.

The present invention includes recognition of the problem posed by storage of bedding, such as bedclothes, bedcovers, bed linen, pillows and pillow cases, sheets, blankets, comforters, bed quilts, duvets and duvet coves, etc. Storage of these items poses a particular problem in that these items are typically bulky and accordingly require a lot of space for storage, such as closet space, drawer space, cabinet space, etc.—space that could be used for storing other articles.

This problem is further exasperated in dwellings having relatively limited storage space, such as apartments, town homes, duplexes, trailer homes, etc. The present invention addresses the above and other problems by providing a storage device for bedding that is relatively easy to manufacture and assemble, and that is adapted for storage of bedding underneath a bed. The storage device of the described embodiments, advantageously, utilizes the space underneath a bed, which typically is wasted space, to store bedding.

By contrast, conventional under-the-bed storage devices, for example, such as described in U.S. Pat. No. 5,020,173 to Dreyer Jr., employ relatively complex designs and are relatively difficult and/or expensive to manufacture and/or may require modifications to existing bed designs. Advantageously, the bedding storage device of the described embodiments can be utilized with existing bed designs by being adapted for storage of bedding in the unused space underneath conventional beds.

Figure 1:
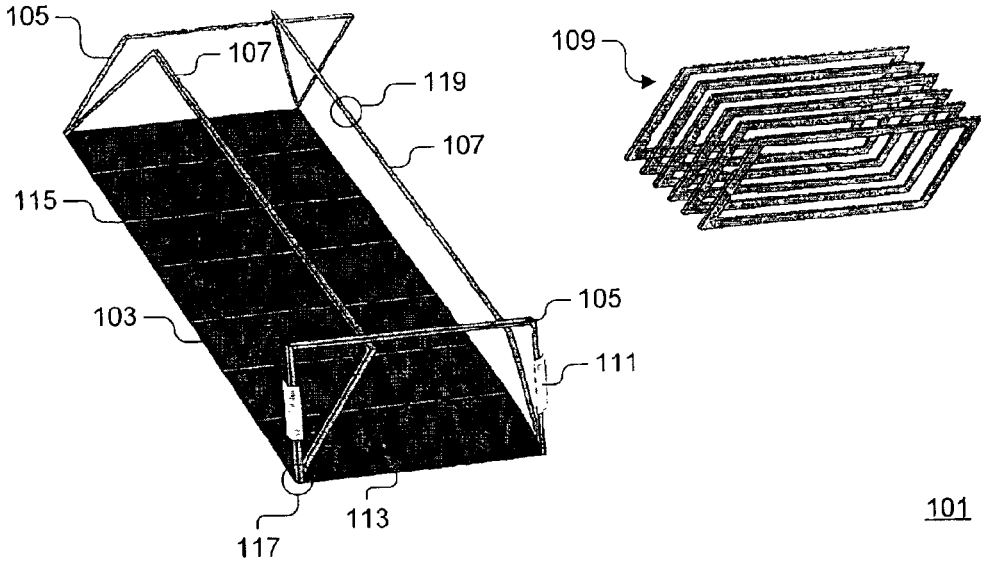
FIG. 1 illustrates an exemplary bedding storage device in an unassembled form, according to one embodiment.

Referring now to the drawings, wherein like reference numerals designate identical or corresponding parts throughout the several views, and more particularly to FIG. 1 thereof, there is illustrated a bedding storage device 101 in an unassembled form, according to one embodiment. As shown in FIG. 1, the bedding storage device 101, is collapsible, and includes a bottom section 103, side sections 107, end sections 105, and divider sections 109. The side sections 107 and the end sections 105 attach to the bottom section 103 at portions 117 and via attachments 111 to form an enclosure for receiving the divider sections 109 at portions 115 and 119.

Figure 2:
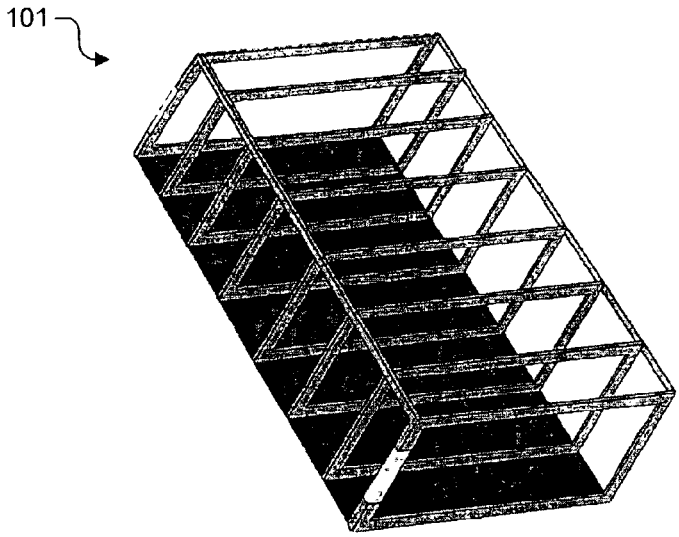
FIG. 2 illustrates the bedding storage device of FIG. 1 in an assembled form.

The divider sections 109 are removably attached (e.g., slide-in, snap-in, etc.) in the enclosure to define compartments for storing bedding, as shown in the assembled bedding storage device 101 of FIG. 2. The size and number of compartments can be varied, advantageously, to accommodate bedding of various sizes, by varying the position and number of divider sections 109 employed in the assembled bedding storage device 101.

The bedding storage device 101 can be manufactured from various materials, including plastic, cardboard, metal, plastic-covered cardboard, etc. The side sections 107, the end sections 105, and the divider sections 109 can be made from solid sheets or made up from frames. The height, width and length of the assembled bedding storage device 101 are adapted so that the assembled bedding storage device 101 fits underneath a bed (e.g., king size, queen size, twin size, etc.).

Figure 3:
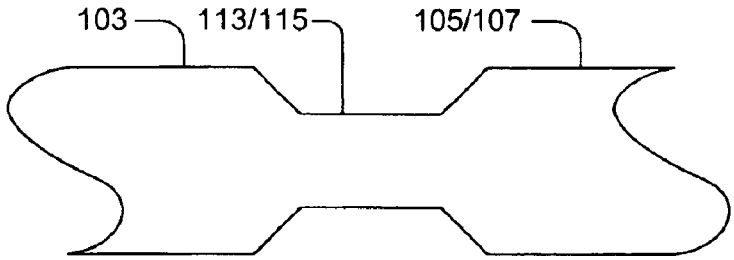
FIGS. 3–10 illustrate exemplary features of the bedding storage device of FIG. 1, according to various embodiments.
Figure 4:
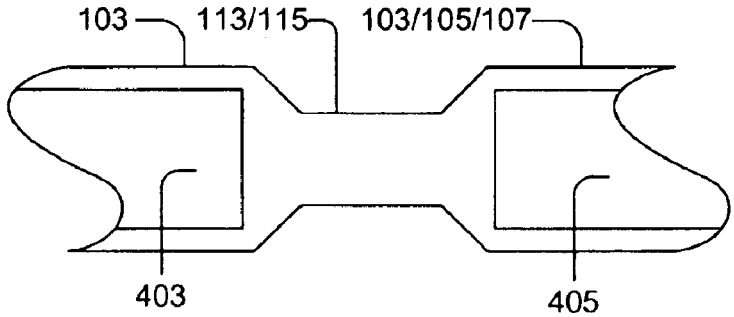

FIGS. 3–10 illustrate exemplary features of the bedding storage device 101 of FIG. 1, according to various embodiments. FIG. 3 illustrates a groove portion 115 on the bottom section 103 for receiving the divider sections 109 or a hinge portion 113 between the bottom section 103 and the side sections 107 or the end sections 105. FIG. 4 illustrates an alternative to the groove portion 115 or the hinge portion 113 of FIG. 3, wherein cardboard sheets 403 and 405 covered with plastic are employed.

Figure 5:
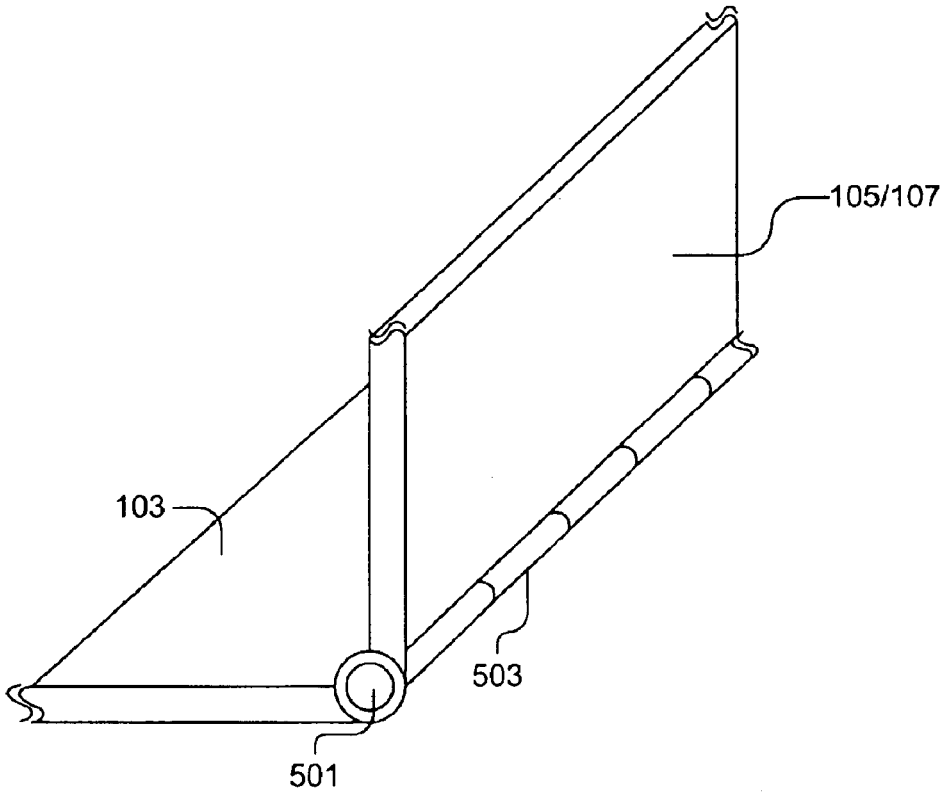

FIG. 5 illustrates alternative hinge portions, including rods 501 and hinges 503. In FIG. 5, the alternative hinge portions can be employed to connect the bottom section 103 with the side sections 107 and the end sections 105 including solid sheets.

Figure 6:
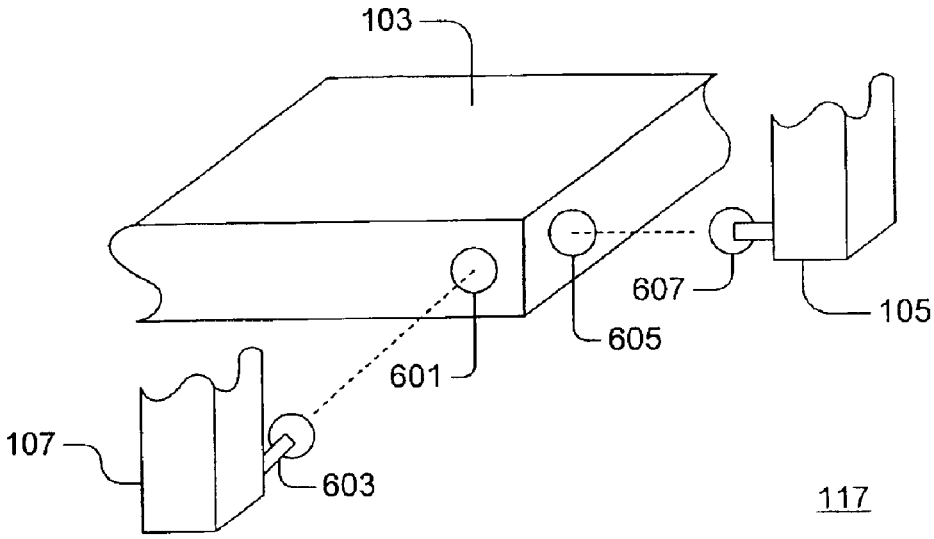

FIG. 6 illustrates alternative ball and socket arrangement 117, including balls 603 and 607, and corresponding sockets 601 and 605. In FIG. 6, the alternative ball and socket arrangement can be employed to connect the bottom section 103 with the side sections 107 and the end sections 105 including frames.

Figure 7:
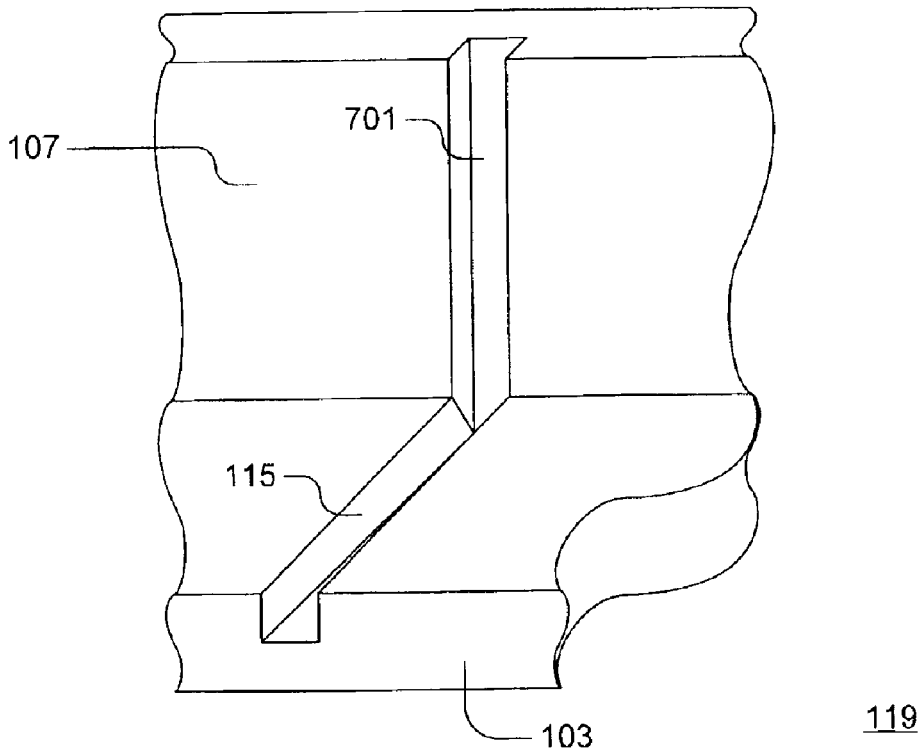

FIG. 7 illustrates portions 119 for receiving the divider sections 109. In FIG. 7, the portions 119 include grooves 701 provided on the side sections 107 and corresponding grooves 115 provided on the bottom section 103. The grooves 115 and 701 provide a means for allowing the divider sections 109 to be removably (e.g., slide-in, snap-in, etc.) attached in the enclosure defined by the side sections 107, the end sections 105, and the bottom section 103. The grooves 115 and 701 can be provided at predetermined distances (e.g., every inch, every two inches, etc.) to allow for varied placement of the divider sections 109.

Figure 8:
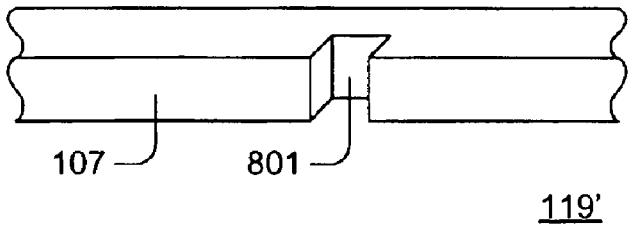

FIG. 8 illustrates alternative portions 119' on the side sections 107 including frames for receiving the divider sections 109. In FIG. 8, the side sections 107 include slots 801 for allowing the divider sections 109 to be removably (e.g., slide-in, snap-in, etc.) attached in the enclosure defined by the side sections 107, the end sections 105, and the bottom section 103.

Figure 9:
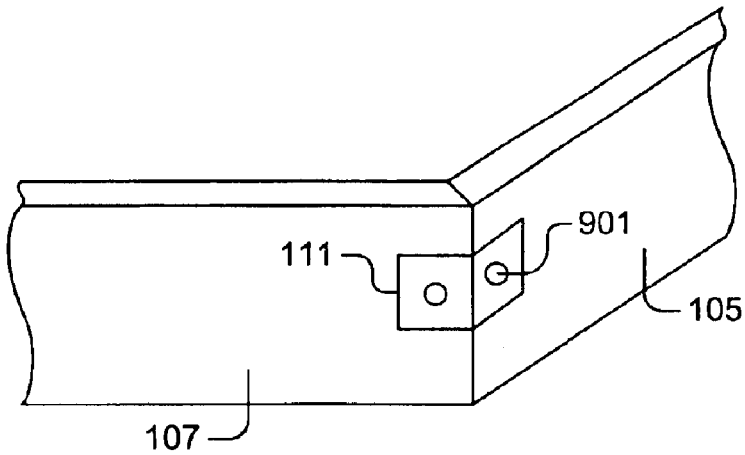

FIG. 9 illustrates attachment portions for attaching the side sections 107 with the end sections 105 including solid sheets. In FIG. 9, the attachment portions include 90° tabs 111 for attaching the side sections 107 with the end sections 105 via fasteners 901 (e.g., screws, nails, threaded bolts, etc.)

Figure 10:
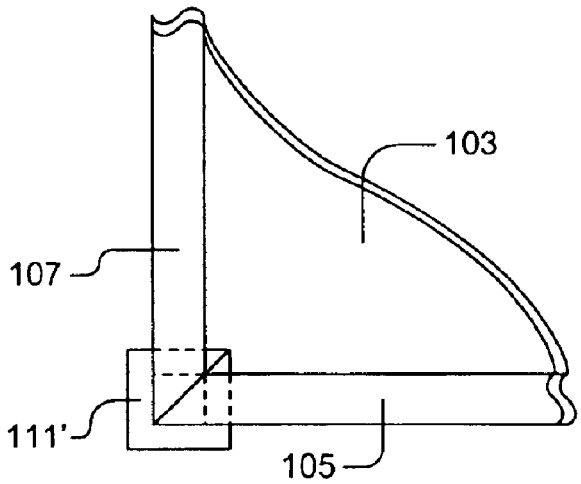

FIG. 10 illustrates alternative attachment portions for attaching the side sections 107 with the end sections 105 including frames. In FIG. 10, the attachment portions include a C-clamp 111' for attaching the side sections 107 with the end sections 105.

Figure 11:
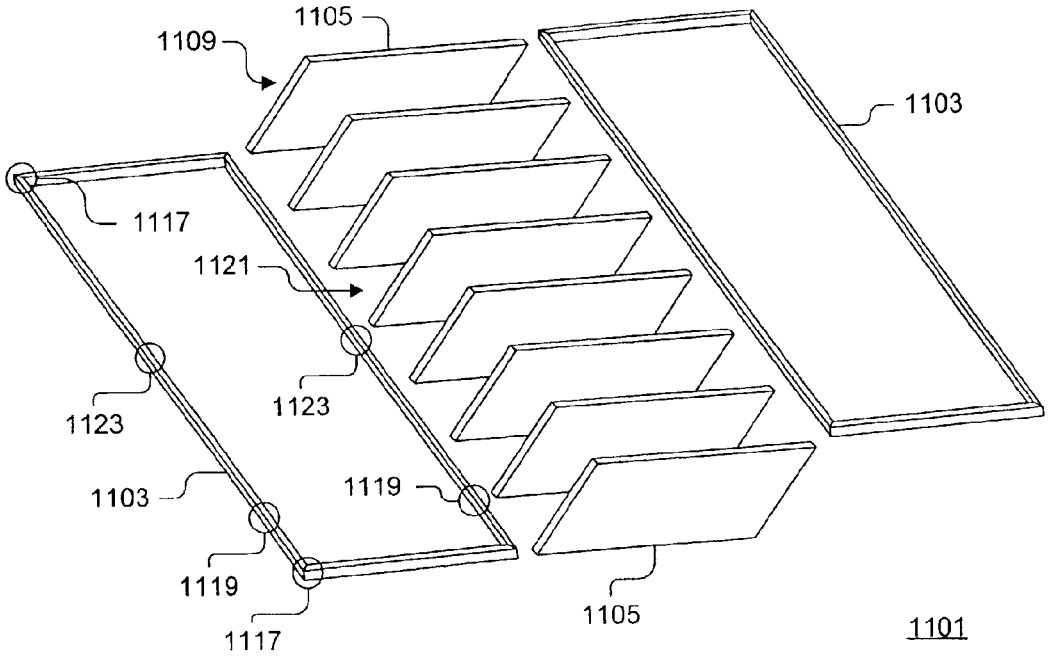
FIG. 11 illustrates an exemplary bedding storage device in an unassembled form, according to another embodiment.

FIG. 11 illustrates an exemplary bedding storage device 1101 in an unassembled form, according to another embodiment. As shown in FIG. 11, the bedding storage device 1101 includes top and bottom frame sections 1103, and divider sections 1109. The divider sections 1109 are removably (e.g., snap-in, slide-in, etc.) attached between the top and bottom frame sections 1103 at portions 1119 and 1117 to form the assembled bedding storage device 1101 shown in FIG. 12. The length of the bedding storage device 1101, advantageously, can be adjusted via optional telescoping portions 1123.

Figure 12:
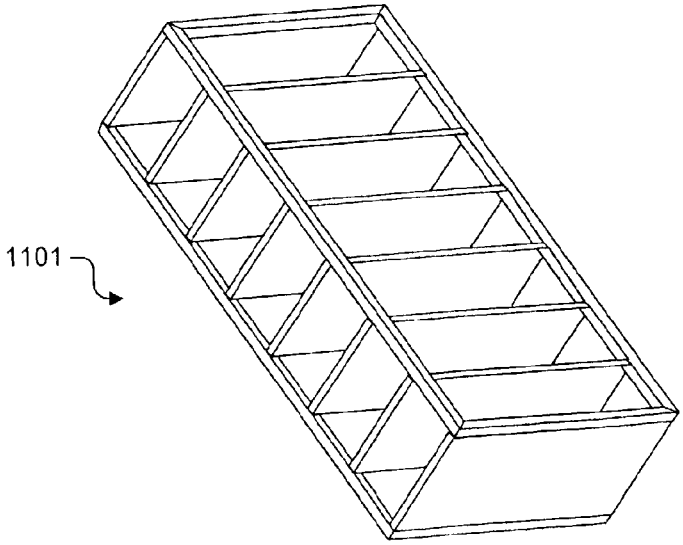
FIG. 12 illustrates the bedding storage device of FIG. 11 in an assembled form.

The divider sections 1109 are removably (e.g., slide-in, snap-in, etc.) attached between the top and bottom frame sections 1103 to define compartments for storing bedding, as shown in the assembled bedding storage device 1101 of FIG. 12. The size and number of compartments can be varied, advantageously, to accommodate bedding of various sizes, by varying the position and number divider sections 1109 and via the optional telescoping portions 1123 employed in the bedding storage device 1101.

The bedding storage device 1101 can be manufactured from various materials, including plastic, cardboard, metal, plastic-covered cardboard, etc. The divider sections 1109 can be made from frames or solid sheets. The height, width and length of the assembled bedding storage device 1101 are adapted so that the assembled bedding storage device 1101 fits underneath a bed (e.g., king size, queen size, twin size, etc.).

Figure 13:
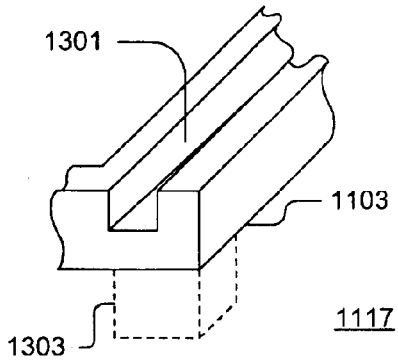
FIGS. 13–15 illustrate exemplary features of the bedding storage device of FIG. 12, according to various embodiments.
Figure 14:
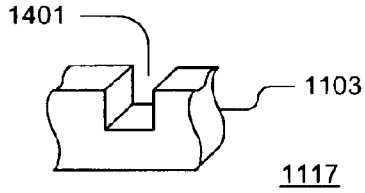
Figure 15:
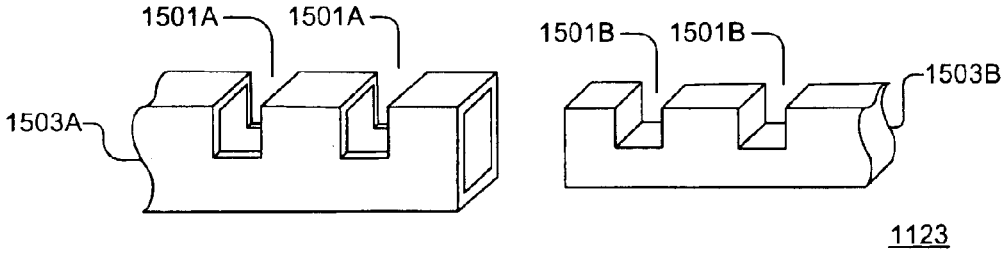

FIGS. 13–15 illustrate exemplary features of the bedding storage device 1101 of FIG. 11, according to various embodiments. FIG. 13 illustrates grooved portions 1117, including grooves 1301, on the ends of top and bottom frame sections 1103 for removably (e.g., slide-in, snap-in, etc.) receiving the end divider sections 1105. Feet 1303 optionally can be provided, for example, on the corners of the bottom frame sections 1103 to raise the bedding storage device 1101 from the ground.

FIG. 14 illustrates slotted portions 1117, including slots 1401, on the top and bottom frame sections 1103 for removably (e.g., slide-in, snap-in, etc.) receiving the middle divider sections 1121. The slots 1401 can be provided at predetermined distances (e.g., every inch, every two inches, etc.) to allow for varied placement of the divider sections 1109.

FIG. 15 illustrates the optional telescoping portions 1123, which can be provided in the top and bottom frame sections 1103. In FIG. 15, the ends of the halves of the top and bottom frame sections 1103 include hollow rectangular tubes 1503A having slots 1501A. The other ends of the other halves of the top and bottom frame sections 1103 include solid rectangular sections 1503B having slots 1501B corresponding to the slots 1501A.

The solid rectangular sections 1503B slide into the corresponding hollow rectangular tubes 1503A and the slots 1501A are aligned with the slots 1501B to allow the top and bottom frame sections 1103 to telescope in length and receive a varying number of the middle divider sections 1121. The slots 1501A and 1501B can be provided at predetermined distances (e.g., every inch, every two inches, etc.) to allow for varied placement of the middle divider sections 1121. Feet optionally can be provided on the comers of the bottom frame sections 1103 to accommodate any height differential between the solid rectangular sections 1503B and the hollow rectangular tubes 1503A and to raise the bedding storage device 1101 from the ground.

Although the bedding storage devices 101 and 1101 are described in terms of being adapted for use for bedding storage underneath a bed, the bedding storage devices 101 and 1101 can be adapted for storage of other articles and in other devices, such automobile trunks, linen closets, etc., as will be appreciated by those skilled in the relevant art(s).

Although the bedding storage devices 1101 is described in terms of having a telescoping section 1123 employing rectangular shapes, the telescoping section 1123 can be configured to employ other shapes, such as circular shapes, etc., as will be appreciated by those skilled in the relevant art(s).

While the present invention has been described in connection with a number of embodiments and implementations, the present invention is not so limited but rather covers various modifications and equivalent arrangements, which fall within the purview of the appended claims.

What is claimed is:

1. A storage device adapted for storage of bedding underneath a bed, comprising a bottom section;

side sections;

end sections; and divider sections, wherein the bottom, side, and end sections define an enclosure, the divider sections are removably attachable within the enclosure to define storage compartments for bedding, and a height, width, and length of the storage device are adapted for placement underneath a bed, wherein the divider sections are removably attached with the bottom and side sections, via corresponding grooves formed in the bottom section, and slots formed in the side sections, and wherein one of:

the bottom sections includes a solid sheet, and the side, end, and divider sections including a frame;

the bottom, side, and end sections include a solid sheet, and the divider sections include a frame; and the bottom section is joined to the side and end sections via respective hinge portions.

2. The storage device of claim 1, wherein the hinge portions include rod and binge arrangements.

3. The storage device of claim 1, wherein the hinge portions include plastic covered cardboard sheets.

4. A storage device adapted for storage of bedding underneath a bed, comprising:

a bottom section;

side sections;

end sections; and divider sections, wherein the bottom, side, and end sections define an enclosure, the divider sections are removably attachable within the enclosure to define storage compartments for bedding, and a height, width, and length of the storage device are adapted for placement underneath a bed, wherein the aide and end sections are removably attached with the bottom section via ball and socket arrangements.

5. The storage device of claim 1, wherein the side and end sections are removably attached with each other, via tabs and fasteners.

6. A storage device adapted for storage of bedding underneath a bed, comprising:

a bottom section;

side sections;

end sections; and divider sections, wherein the bottom, side, and end sections define an enclosure, the divider sections are removably attachable within the enclosure to define storage compartments for bedding, and a height, width, and length of the storage device are adapted for placement underneath a bed, wherein the side and end sections are removably attached with each other, via a C-clamp.

7. A storage device adapted for storage of bedding underneath a bed, comprising:

top and bottom sections; and divider sections, wherein the divider sections are removably attached between the top and bottom sections, the top, bottom, and divider sections define storage compartments for bedding, and a height, width, and length of the storage device are adapted for placement underneath a bed, wherein ends of the top and bottom sections include a longitudinal ridge for receiving end dividers of the divider sections.

8. The storage device of claim 7, wherein the top and bottom sections include a frame, and the divider sections include a solid sheet.

9. The storage device of claim 7, wherein the top, bottom, end divider sections include a flame.

10. A storage device adapted for storage of bedding underneath a bed, comprising:

top and bottom sections; and divider sections, wherein the divider sections are removably attached between the top and bottom sections, the top, bottom, and divider sections define storage compartments for bedding, and a height, width, and length of the storage device are adapted for placement underneath a bed, wherein middle sections of the top end bottom sections include slots for receiving middle dividers of the divider sections.

11. The storage device of claim 10, wherein the bottom section includes feet formed thereon for raising the storage device from the ground.

12. The storage device of claim 10, wherein the top and bottom sections include a telescoping means to adjust a length of the top end bottom sections.

13. A storage device adapted for storage of bedding underneath a bed, comprising:

top and bottom sections; and divider sections having telescoping means, wherein the divider sections are removably attached between the top and bottom sections, the top, bottom, end divider sections define storage compartments for bedding, and a height, width, and length of the storage device are adapted for placement underneath a bed, wherein the telescoping means includes hollow rectangular-shaped ends mid corresponding solid rectangular-shaped ends formed on the top and bottom section, and the hollow rectangular-shaped ends slidably engage with the solid rectangular-shaped ends to adjust the length of the top and bottom sections and wherein the rectangular-shaped ends and the solid rectangular-shaped ends include corresponding slots that an aligned to receive the divider section.

* * * * *